US005486381A

United States Patent [19]

Cleveland et al.

[11] Patent Number: 5,486,381

[45] Date of Patent: Jan. 23, 1996

[54] LIQUID SATURATION PROCESS

[75] Inventors: Terry R. Cleveland, Woodstock; Cherie H. Everhart, Alpharetta; Fred R. Radwanski; Henry Skoog, both of Roswell, all of Ga.

[73] Assignee: Kimberly-Clark Corporation, Neenah, Wis.

[21] Appl. No.: 231,608

[22] Filed: Apr. 22, 1994

[51] Int. Cl.[6] ..... B05D 1/30

[52] U.S. Cl. ..... 427/294; 427/420; 427/308; 427/350; 118/324

[58] Field of Search ..... 427/294, 299, 427/420, 308, 350; 118/324, DIG. 9; 162/20 S, 134, 135, 136, 137

[56] References Cited

U.S. PATENT DOCUMENTS

| | | | |
|---|---|---|---|
| 4,427,722 | 1/1984 | Keller | 118/DIG. 4 |
| 4,466,993 | 8/1984 | Hsu et al. | 118/DIG. 4 |
| 4,520,048 | 5/1985 | Ranger | 427/350 |

*Primary Examiner*—Robert A. Dawson

*Assistant Examiner*—David Reifsnyder

*Attorney, Agent, or Firm*—Karl V. Sidor

[57] ABSTRACT

Disclosed is a continuous process of non-compressively and uniformly applying a liquid saturant throughout a permeable sheet. The process includes the steps of: 1) providing a continuously advancing permeable sheet having a first surface and a second surface, 2) depositing a substantially laminar flowing curtain of a liquid saturant generally across and onto the first surface of the continuously advancing permeable sheet, 3) applying a vacuum to the second surface of the continuously advancing permeable sheet, and 4) drawing a substantial portion of the liquid saturant through the permeable sheet to generate a substantially uniform distribution of liquid saturant throughout the permeable sheet. The process may also include the step of drying the liquid saturated permeable sheet. The dry bulk of the liquid saturant treated permeable sheet may be within about 15 percent of the dry bulk of an identical untreated permeable sheet. Also disclosed is a non-compressively and uniformly liquid saturant treated permeable sheet and an apparatus for non-compressively and uniformly applying a liquid saturant throughout a permeable sheet.

4 Claims, 1 Drawing Sheet

LIQUID SATURATION PROCESS

FIELD OF THE INVENTION

This invention relates to a process of applying a liquid saturant to a permeable sheet.

BACKGROUND OF THE INVENTION

There are many ways to apply a liquid saturant to a permeable sheet. For example, a saturant such as a dye solution may be applied to permeable sheets by a size press or dip/dunk and press process. Such processes may be unsatisfactory for some applications because the compressive forces involved may diminish sheet bulk and desirable properties associated with bulk. In addition, it may be difficult to achieve a uniform distribution of the saturant throughout the permeable sheet (e.g., throughout the interior of the permeable sheet).

Processes such as printing or spraying may also be used to apply a saturant such as a dye solution. Printing processes and spraying generally apply a saturant to a single surface of a sheet. Such processes may be unsatisfactory because they may create additional complexity if it is desired to apply a saturant to both sides of a sheet. Also, such processes may have difficulty achieving uniform distribution of the saturant throughout the permeable sheet.

Some types of permeable sheets are made by wet-forming processes. Liquid saturant may be applied to such sheets by adding saturant to the water used in the wet-forming process. Such a process may make relatively inefficient use of the saturant, especially if the process water is not properly recycled.

Thus, a need exists for a practical process for non-compressively and uniformly applying a liquid saturant throughout a permeable sheet. There is also a need for a practical process for non-compressively and uniformly applying a liquid saturant throughout a permeable fibrous cellulosic material. There is also a need for a practical apparatus for non-compressively and uniformly applying a liquid saturant throughout a permeable sheet.

DEFINITIONS

As used herein, the term "nonwoven web" refers to a web that has a structure of individual fibers or filaments which are interlaid, but not in an identifiable repeating manner. Nonwoven webs have been, in the past, formed by a variety of processes known to those skilled in the art such as, for example, meltblowing, spunbonding, wet-forming and various bonded carded web processes.

As used herein, the term "spunbonded web" refers to a web of small diameter fibers and/or filaments which are formed by extruding a molten thermoplastic material as filaments from a plurality of fine, usually circular, capillaries in a spinnerette with the diameter of the extruded filaments then being rapidly reduced, for example, by non-eductive or eductive fluid-drawing or other well known spunbonding mechanisms. The production of spunbonded nonwoven webs is illustrated in patents such as Appel, et al., U.S. Pat. No. 4,340,563.

As used herein, the term "meltblown fibers" means fibers formed by extruding a molten thermoplastic material through a plurality of fine, usually circular, die capillaries as molten threads or filaments into a high-velocity gas (e.g. air) stream which attenuates the filaments of molten thermoplastic material to reduce their diameters, which may be to microfiber diameter. Thereafter, the meltblown fibers are carried by the high-velocity gas stream and are deposited on a collecting surface to form a web of randomly disbursed meltblown fibers. The meltblown process is well-known and is described in various patents and publications, including NRL Report 4364, "Manufacture of Super-Fine Organic Fibers" by V. A. Wendt, E. L. Boone, and C. D. Fluharty; NRL Report 5265, "An Improved Device for the Formation of Super-Fine Thermoplastic Fibers" by K. D. Lawrence, R. T. Lukas, and J. A. Young; and U.S. Pat. No. 3,849,241, issued Nov. 19, 1974, to Buntin, et al.

As used herein, the term "microfibers" means small diameter fibers having an average diameter not greater than about 100 microns, for example, having a diameter of from about 0.5 microns to about 50 microns, more specifically microfibers may also have an average diameter of from about 1 micron to about 20 microns. Microfibers having an average diameter of about 3 microns or less are commonly referred to as ultra-fine microfibers. A description of an exemplary process of making ultra-fine microfibers may be found in, for example, U.S. Pat. No. 5,213,881, entitled "A Nonwoven Web With Improved Barrier Properties".

As used herein, the term "fibrous cellulosic material" refers to a nonwoven web including cellulosic fibers (e.g., pulp) that has a structure of individual fibers which are interlaid, but not in an identifiable repeating manner. Such webs have been, in the past, formed by a variety of nonwoven manufacturing processes known to those skilled in the art such as, for example, air-forming, wet-forming and/or paper-making processes. Exemplary fibrous cellulosic materials include papers, tissues and the like. Such materials can be treated to impart desired properties utilizing processes such as, for example, calendering, creping, hydraulic needling, hydraulic entangling and the like. Generally speaking, the fibrous cellulosic material may be prepared from cellulose fibers from synthetic sources or sources such as woody and non-woody plants. Woody plants include, for example, deciduous and coniferous trees. Non-woody plants include, for example, cotton, flax, esparto grass, milkweed, straw, jute, hemp, and bagasse. The cellulose fibers may be modified by various treatments such as, for example, thermal, chemical and/or mechanical treatments. It is contemplated that reconstituted and/or synthetic cellulose fibers may be used and/or blended with other cellulose fibers of the fibrous cellulosic material. Fibrous cellulosic materials may also be composite materials containing cellulosic fibers and one or more non-cellulosic fibers and/or filaments. A description of a fibrous cellulosic composite material may be found in, for example, U.S. Pat. No. 5,284,703.

As used herein, the term "pulp" refers to cellulosic fibrous material from sources such as woody and non-woody plants. Woody plants include, for example, deciduous and coniferous trees. Non-woody plants include, for example, cotton, flax, esparto grass, milkweed, straw, jute, hemp, and bagasse. Pulp may be modified by various treatments such as, for example, thermal, chemical and/or mechanical treatments.

As used herein, the term "solution" refers to any relatively uniformly dispersed mixture of one or more substances (e.g., solute) in one or more other substances (e.g., solvent). Generally speaking, the solvent may be a liquid such as, for example, water and/or mixtures of liquids. The solvent may contain additives such as suspension agents, viscosity modifiers and the like. The solute may be any material adapted to uniformly disperse in the solvent at the appropriate level, (e.g., ionic level, molecular level, colloidal particle level or as a suspended solid). For example, a solution may be a uniformly dispersed mixture of ions, of molecules, of colloidal particles, or may even include mechanical suspensions.

As used herein, the terms "permeable" and "permeability" refer to the ability of a fluid, such as, for example, a gas to pass through a particular porous material. Permeability may be expressed in units of volume per unit time per unit area, for example, (cubic feet per minute) per square foot of material (e.g., ($ft^3$/minute/$ft^2$). Permeability was determined utilizing a Frazier Air Permeability Tester available from the Frazier Precision Instrument Company and measured in accordance with Federal Test Method 5450, Standard No. 191A, except that the sample size was 8"×8" instead of 7"×7". Although permeability is generally expressed as the ability of air or other gas to pass through a permeable sheet, sufficient levels of gas permeability may correspond to levels of liquid permeability to enable the practice of the present invention. For example, a sufficient level of gas permeability may allow an adequate level of liquid to pass through a permeable sheet with or without assistance of a driving force such as, for example, an applied vacuum or applied gas pressure.

As used herein, the terms "laminar flow" and "laminar flowing" refer to a condition of fluid flow (e.g., liquid flow) in a conduit in which the fluid particles or streams tend to move parallel to the flow axis and not mix. Laminar flow is distinguished from turbulent flow which may be characterized as a diffused pattern of flow. For the purposes of the present invention, laminar flow is a generally calm, smooth, quiet flow and is not intended to be limited to the Reynolds number definitions of laminar flow.

As used herein, the term "bulk" refers to the thickness of samples measured with a Model 49-70 thickness tester available from TMI (Testing Machines Incorporated) of Amityville, N.Y. The thickness tester was equipped with a 2-inch diameter circular foot and measurements were taken at an applied pressure of about 0.2 pounds per square inch (psi). Bulk measurements of samples that are substantially dry (i.e., having a moisture content generally less than about 10 percent, by weight, as determined by conventional methods) may be referred to as dry bulk.

As used herein, the term "substantive" refers to the ability of a material in solution to be taken up directly by fibers or other components of a permeable sheet, generally by some form of adsorption. For example, a water-soluble dye in aqueous solution that can be selectively adsorbed by certain types of fibrous material such as, for example, cellulosic fibrous material may be considered substantive to cellulosic fibers.

SUMMARY OF THE INVENTION

The problems described above are addressed by the present invention which is directed to a continuous process of non-compressively and uniformly applying a liquid saturant treatment throughout a permeable sheet. The process includes the following steps: 1) providing a continuously advancing permeable sheet having a first surface and a second surface; 2) depositing a substantially laminar flowing curtain of a liquid saturant generally across the width and onto the first surface of the continuously advancing permeable sheet; 3) applying a vacuum to the second surface of the continuously advancing permeable sheet; and 4) drawing a substantial portion of the liquid saturant through the permeable sheet to generate a substantially uniform distribution of liquid saturant throughout the permeable sheet. The process may further include the step of drying the liquid saturated permeable sheet.

According to the present invention, the dry bulk of the liquid saturant treated permeable sheet should be within about 15 percent of the dry bulk of an identical untreated permeable sheet. Desirably, the dry bulk of the liquid saturant treated permeable sheet is substantially the same as an identical untreated permeable sheet.

Generally speaking, the permeable sheet may have a permeability of at least about 20 cfm/$ft^2$ as measured for a substantially dry sheet prior to processing. For example, the permeable sheet may have a permeability of 50 to over 200 cfm/$ft^2$, as measured for a substantially dry sheet prior to processing.

A continuous, substantially laminar flowing curtain of a liquid saturant may be deposited on the permeable sheet at a rate of at least about 0.15 gallons per minute per inch of curtain width. For example, a liquid saturant may be deposited on the permeable sheet at a rate of at least about 0.2 to over about 0.75 gallons per minute per inch of curtain width. In an aspect of the present invention, the liquid saturant should be able to flow freely and may have a viscosity of from about 0.4 to about 20 centipoise. In another aspect of the present invention, the liquid saturant may be a saturant that is substantive to specific materials in the permeable sheet. For example, the liquid saturant may be a dye solution that is substantive to cellulosic materials.

According to the invention, a vacuum may be applied substantially simultaneous with the deposition of the liquid saturant. Generally speaking, the vacuum level should be sufficient to draw a substantial portion of the saturant through the permeable sheet. As an example, the vacuum level may be greater than about 60 inches of water. As another example, the vacuum level may range from about 60 to about 270 or more inches of water. In another aspect of the invention, the level of vacuum may be adjusted so the liquid saturant is drawn only partially through the permeable sheet to generate a substantially non-uniform distribution of liquid saturant throughout the permeable sheet. For example, the level of vacuum may be adjusted so the liquid saturant is drawn only partially through the permeable sheet to generate a generally graduated distribution of liquid saturant between the first surface and second surface of the permeable sheet.

The permeable sheet may be, for example, woven fabrics, knit fabrics, nonwoven fabrics, fibrous batts, fibrous mats and combinations of the same. Desirably, the permeable sheet is a permeable, nonwoven fibrous cellulosic material. Exemplary nonwoven fibrous cellulosic materials include nonwoven fibrous cellulosic composite materials, cellulosic tissue materials, nonwoven fibrous cellulosic laminate materials and combinations of the same. The nonwoven fibrous cellulosic composite material may be composed of a pulp component and a continuous filament component and/or other nonwoven fibrous component. If the permeable sheet contains a fibrous cellulosic material component, the fibrous cellulosic material may be at least partially hydrated prior to the step of depositing the continuous, substantially laminar flowing curtain of a liquid saturant. For example, the permeable sheet may have a consistency of at least about 20 percent, by weight, solid material. As another example, the permeable sheet may have a consistency of at least about 30 percent, by weight, solid material. The permeable sheet may be pre-treated utilizing a surface modification technique such as, for example, chemical etching, chemical oxidation, ion bombardment, plasma treatments, flame treatments, heat treatments, and corona discharge treatments.

The present invention encompasses a liquid saturant treated sheet produced according to the process described above. Such a liquid saturant treated sheet may contain: 1) a permeable sheet; and 2) a substantially uniform distribution of a liquid saturant treatment throughout the sheet. According to the invention, the treated sheet is adapted to have a dry bulk which is within about 15 percent of an identical untreated sheet. The liquid saturant treated sheet produced according to the process described above may be a liquid saturant treated nonwoven fibrous cellulosic material containing: 1) a permeable nonwoven fibrous cellulosic material; and 2) a substantially uniform distribution of a liquid saturant treatment throughout the nonwoven fibrous cellulosic material and in which the treated nonwoven fibrous cellulosic material is adapted to have a dry bulk which is within about 15 percent of an identical untreated nonwoven fibrous cellulosic material. The liquid saturant treated nonwoven fibrous cellulosic material may have a dry bulk that is substantially the same as an identical untreated nonwoven fibrous cellulosic material.

The present invention encompasses a continuous, short dwell time process of non-compressively and uniformly applying a liquid saturant throughout a permeable sheet. The process includes the following steps: 1) providing a continuously advancing permeable sheet having a first surface and a second surface; 2) depositing a substantially laminar flowing curtain of liquid saturant generally across the width and onto the first surface of the continuously advancing permeable sheet; 3) applying a vacuum to the second surface of the continuously advancing permeable sheet substantially simultaneous with the deposition of the liquid saturant; and 4) drawing a substantial portion of the liquid saturant through the permeable sheet in less than about 1 second to generate a substantially uniform distribution of liquid saturant throughout the permeable sheet.

According to the invention, a substantial portion of the liquid saturant may be drawn through the permeable sheet in less than about 0.1 second. For example, a substantial portion of the liquid saturant may be drawn through the permeable sheet in less than about 0.01 second. As another example, a substantial portion of the liquid saturant may be drawn through the permeable sheet in less than about 0.001 second.

The present invention also encompasses an apparatus for continuously, non-compressively and uniformly applying a liquid saturant treatment throughout a permeable sheet. The apparatus contains: 1) means for continuously advancing a permeable sheet having a first surface and a second surface; 2) means for depositing a substantially laminar flowing curtain of liquid saturant substantially across and onto the first surface of the continuously advancing permeable sheet; and 3) vacuum means substantially contacting the second surface of the continuously advancing permeable sheet to draw the liquid saturant through the permeable sheet to generate a substantially uniform distribution of liquid saturant throughout the permeable sheet.

In one aspect of the invention, the means for advancing the permeable sheet may be, for example, a moving foraminous belt, permeable fabric, netting, webbing or the like. It is contemplated that the permeable sheet may be self-supporting and need not be transported on a moving belt or the like.

According, to the invention, the means for depositing a substantially laminar flowing curtain of liquid saturant may be composed of at least one liquid distribution element. For example, multiple liquid distribution elements may be arranged in series. Desirably, the means for depositing a continuous, substantially laminar flowing curtain of liquid saturant should be adapted to handle flow rates of at least about 0.15 gallons per minute per inch of curtain width. For example, the means for depositing a continuous, substantially laminar flowing curtain of liquid saturant should be adapted to handle flow rates of at least about 0.2 to over about 0.75 gallons per minute per inch of curtain width. The liquid distribution element may be a spillway adapted to produce substantially laminar flow of liquid. Desirably, the liquid distribution element may be composed of a turbulence reducing reservoir and a spillway adapted to produce a substantially laminar flow of liquid.

The vacuum means may be composed of at least one vacuum element. For example, multiple vacuum elements may be arranged in series. The vacuum element may be a conventional vacuum channel or groove such as, for example, a vacuum slot. The vacuum means should be adapted to handle flow rates of liquid saturant corresponding to at least about the same flow rate deposited on the first surface of the permeable sheet. For example, the vacuum means should be adapted to handle flow rates corresponding to at least about 0.15 gallons per minute per inch of curtain width (deposited on the first surface of the permeable sheet). For example, the vacuum means should be adapted to handle flow rates of liquid saturant corresponding to at least about 0.2 to over about 0.75 gallons per minute per inch of curtain width (deposited on the first surface of the permeable sheet).

DETAILED DESCRIPTION OF THE INVENTION

Figure 1:
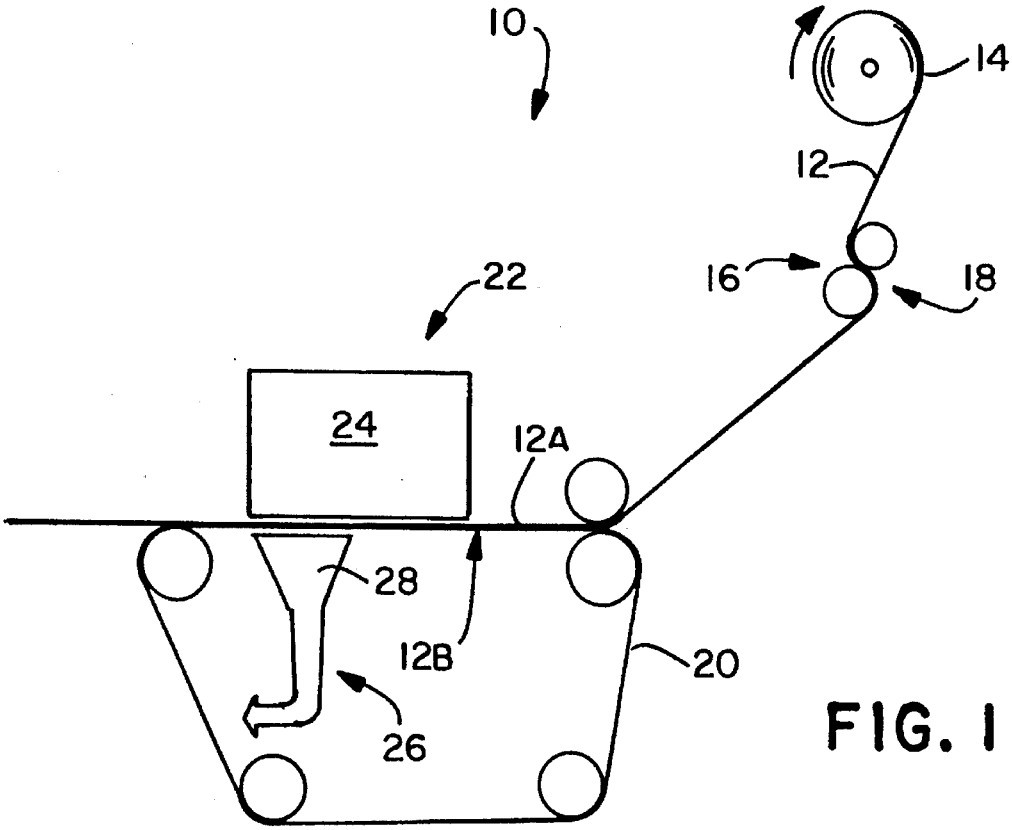
FIG. 1 is an illustration of an exemplary continuous process of non-compressively and uniformly applying a liquid saturant throughout a permeable sheet.

Referring to the drawing and in particular to FIG. 1, there is shown at 10 an exemplary continuous process of non-compressively and uniformly applying a liquid saturant throughout a permeable sheet.

According to the present invention, a permeable sheet 12 is unwound from a supply roll 14 and travels in the direction indicated by the arrow associated therewith as the supply roll 14 rotates in the direction of the arrows associated therewith. The permeable sheet 12 may be formed by one or more sheet making processes and passed directly into the process 10 without first being stored on a supply roll 14. Exemplary sheet-making processes include processes such as meltblowing processes, spunbonding processes, bonded-carded web-making processes, wet-laying processes and the like.

The permeable sheet may be passed through a pre-treatment station to modify the sheet. For example, the sheet may be calendered with a flat roll, point bonded or pattern bonded in order to achieve desired physical and/or textural characteristics. Additionally, at least a portion of a surface of the sheet may be modified by various known surface modification techniques prior to entering the continuous process of non-compressively and uniformly applying a liquid saturant throughout a permeable sheet. Exemplary surface modification techniques include, for example, chemical etching, chemical oxidation, ion bombardment, plasma treatments, flame treatments, heat treatments, and/or corona discharge treatments.

The permeable sheet may be a nonwoven fibrous web such as, for example, a bonded carded web, spunbonded web, web of meltblown fiber, a multi-ply fibrous web containing the same type of fibrous web or a multi-ply fibrous web containing different types of fibrous webs. If the permeable sheet is a web of meltblown fibers, it may include meltblown microfibers. These nonwoven webs may be formed from thermoplastic polymers or thermoset polymers. If the nonwoven web is formed from a polyolefin, the polyolefin may be polyethylene, polypropylene, polybutene, ethylene copolymers, propylene copolymers and butene copolymers. The fibers and/or filaments may be formed from blends that contain various pigments, additives, strengthening agents, flow modifiers and the like. Such fabrics are described in U.S. Pat. Nos. b 4,041,203, 4,374,888,and 4,753,843, the contents of which are incorporated herein by reference. Those patents are assigned to the Kimberly-Clark Corporation, the assignee of the present invention.

The permeable sheet may be a nonwoven web that may also be a composite material made of a mixture of two or more different fibers or a mixture of fibers and particulates. Such mixtures may be formed by adding fibers and/or particulates to the gas stream in which meltblown fibers are carried so that an intimate entangled commingling of meltblown fibers and other materials, e.g., wood pulp, staple fibers and particulates such as, for example, activated carbon, silica, and hydrocolloid (hydrogel) particulates commonly referred to as superabsorbant materials, occurs prior to collection of the meltblown fibers upon a collecting device to form a coherent web of randomly dispersed meltblown fibers and other materials such as disclosed in U.S. Pat. No. 4,100,324, the disclosure of which is hereby incorporated by reference.

If the permeable sheet is a nonwoven web, the fibrous material in the nonwoven web may be joined by interfiber bonding to form a coherent web structure. Interfiber bonding may be produced by entanglement between individual meltblown fibers, carded fibers, spunbond filaments and/or other fibrous materials Some fiber entangling is inherent in the meltblown process, bonding-carding process and/or spunbond process but may be generated or increased by processes such as, for example, hydraulic entangling or needlepunching. Alternatively and/or additionally a bonding agent may be used to increase the desired bonding. If at least a portion of the fibrous material in the permeable sheet is cellulosic fibrous material, some interfiber bonding may be attributable to "paper" bonding.

The permeable sheet (prior to processing) may have a basis weight ranging from about 15 gsm to about 200 gsm. For example, the permeable sheet may have a basis weight ranging from about 25 gsm to about 100 gsm. Desirably, the permeable sheet may have a basis weight ranging from about 20 gsm to about 90 gsm.

The permeable sheet 12 passes through the nip 16 of an S-roll arrangement 18 in a reverse-S path. From the S-roll arrangement 18, the permeable sheet 12 passes to a means for continuously advancing 20 the permeable sheet throughout the liquid saturant treatment process. Generally speaking, the means for continuously advancing 20 the permeable sheet may be, for example, a moving foraminous belt, a permeable fabric, netting, webbing or the like. It is contemplated that the permeable sheet 12 may be self-supporting and need not be transported on a moving belt.

The permeable sheet 12 then passes under a means for depositing a substantially laminar flowing curtain of liquid saturant 22 substantially across and onto a first surface 12A of the continuously advancing permeable sheet. According, to the invention, the means for depositing a substantially laminar flowing curtain of liquid saturant 22 may be composed of at least one liquid distribution element 24. For example, multiple liquid distribution elements 24 may be arranged in series. The liquid distribution element 24 may be a spillway adapted to produce a substantially laminar flow of liquid. Desirably, the liquid distribution element may be composed of a turbulence reducing reservoir and a spillway adapted to produce a substantially laminar flow of liquid.

Figure 2:
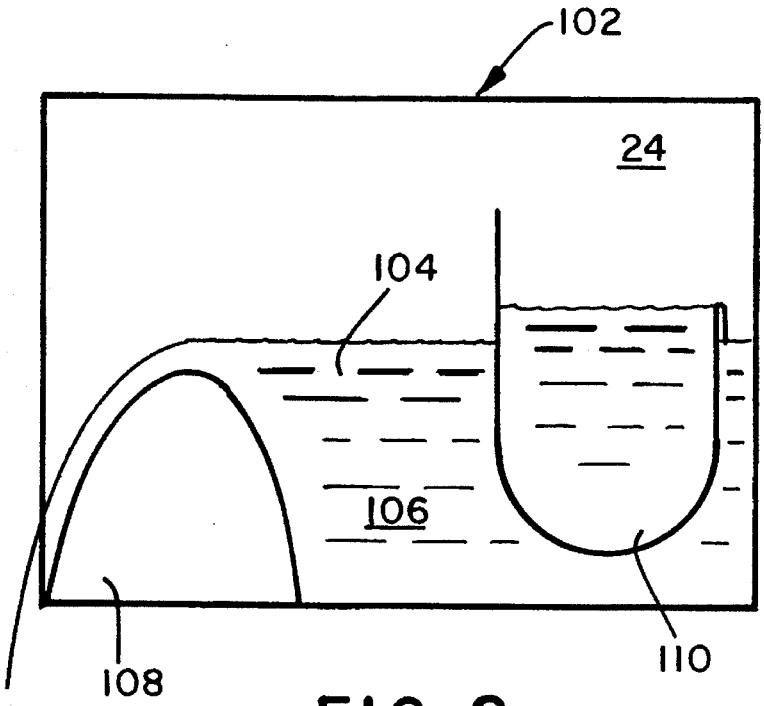
FIG. 2 is an illustration of an exemplary liquid distribution element.

Referring now to FIG. 2 of the drawings, there is shown at 100 an exemplary liquid distribution element 24 (not necessarily to scale). The liquid distribution element 24 is essentially a large container 102 with an inlet (not shown) which supplies liquid 104, a reservoir 106, a spillway 108, and a weir or baffle 110. Generally speaking, the inlet should be designed to reduce liquid turbulence in the reservoir 106. Conventional turbulence reducing techniques and/or devices may be used. Exemplary techniques include, for example, adding vanes or fins, modifying flow rates and/or modifying the dimensions of the reservoir and/or inlet. Liquid 104 enters the liquid distribution element at an inlet (not shown) and passes through a weir or baffle 110 into the reservoir 106. The weir or baffle 110 is intended to reduce turbulence in the reservoir 106. Liquid 104 then travels over a spillway 108 which may have a smoothly curved and continuously even surface in a substantially laminar flow. Desirably, the lowest lip of the spillway 108 will be a very short distance above the permeable sheet. For example, the lowest lip of the spillway may be less than one inch above the permeable sheet to minimize the distance liquid must free-fall. The spillway may have other conventional designs. For example, the spillway may be straight, fluted, patterned or the like.

Although the inventors should not be held to a particular theory of operation, it is generally thought the laminar flow of the liquid saturant onto the permeable sheet enhances uniform application of the liquid.

The means for depositing a continuous, substantially laminar flowing curtain of liquid saturant 22 should be adapted to handle flow rates of at least about 0.15 gallons per minute per inch of curtain width. For example, the means for depositing a continuous, substantially laminar flowing curtain of liquid saturant 22 should be adapted to handle flow rates of at least about 0.2 to over about 0.75 gallons per minute per inch of curtain width. The curtain width may be any width suitable to extend across the width of the material to be liquid treated. Widths in excess of nine feet are contemplated. At such widths, flow rates into the liquid distribution element may exceed 75 gallons per minute. Generally speaking, the continuous, substantially laminar flowing curtain of liquid saturant may have the form of a relatively thin film of liquid as it flows onto and across the permeable sheet. The thickness of the curtain may be dependent upon such factors as, for example, viscosity, flow rate and design of the liquid distribution means. Thickness of the curtain may range from about one to about ten millimeters, although other thicknesses could be used.

The flow rate and substantially laminar flow of the curtain of liquid are generally intended to avoid disturbing the structure of the permeable sheet. This stands in contrast to processes such as, for example, hydraulic entangling which specifically intends liquid flows that disturb, entangle and/or intertwine components (e.g., fibers) in the structure of a web or sheet.

Referring again to FIG. 1, means for applying a vacuum 26 to the second surface of the continuously advancing permeable sheet are located near the liquid deposition element 24. Desirably, the vacuum is applied substantially simultaneous with the deposition of the liquid saturant. Generally speaking, the vacuum means 26 may be composed of at least one vacuum element 28. Multiple vacuum elements 28 may be arranged in series. The vacuum element 28 may be a conventional vacuum channel or groove such as, for example, a vacuum slot. The vacuum means 26 should be adapted to handle flow rates of liquid saturant corresponding to the flow rates out of the liquid deposition means 22.

Upon application of the vacuum to the second surface 12B of the permeable sheet, a substantial portion of the liquid saturant is drawn from the first surface 12A and substantially through the permeable sheet. This passage of the liquid saturant through the permeable sheet is generally thought to generate a substantially uniform distribution of liquid saturant throughout the permeable sheet. Generally speaking, evacuation of liquid saturant to achieve a desirable substantially uniform distribution of liquid may be accomplished with a sheet having a permeability of at least about 20 cfm/ft$^2$, as measured for a substantially dry sheet prior to being processed. For example, the permeability of the sheet range from about 50 to over 200 cfm/ft$^2$, as measured for a substantially dry sheet prior to being processed. If a sheet has inadequate impermeability, the liquid saturant may puddle or pool on the first surface and may be non-uniformly concentrated, absorbed or diffused through the sheet.

The permeable sheet 12 may then be passed to a drying operation (not shown). Exemplary drying operations include processes which incorporate infra-red radiation, yankee dryers, steam cans, microwaves, hot-air and/or through-air drying techniques, and ultrasonic energy.

According to the invention, the liquid saturant should be able to flow freely. For example, the liquid saturant may have a viscosity of from about 0.4 to about 20 centipoise. While low viscosity liquids are prone to turbulent flow, liquid viscosities in the region of about 1.0 centipoise are generally considered desirable. However, it is contemplated that more viscous liquid saturants could be used in the practice of the present invention. Although the inventors should not be held to a particular theory of operation, it is thought that the ability of the liquid saturant to flow freely (and in relatively large volumes) through the sheet with the assistance of an applied vacuum enhances the substantially uniform distribution of the liquid saturant throughout the sheet.

According to the invention, a substantial portion of the liquid saturant may be drawn through the sheet in less than about 1 second to generate a substantially uniform distribution of liquid saturant throughout the permeable sheet. For example, a substantial portion of the liquid saturant may be drawn through the permeable sheet in less than about 0.1 second. As a further example, a substantial portion of the liquid saturant may be drawn through the permeable sheet in less than about 0.01 second. As yet another example, a substantial portion of the liquid saturant may be drawn through the permeable sheet in less than about 0.001 second. The expression "a substantial portion of liquid saturant may be drawn through the sheet" generally refers to evacuating or drawing off liquid at the second surface of the permeable sheet at a rate which is at least about 50 percent of the rate at which the liquid is deposited on the first surface of the sheet. For example, liquid may be evacuated or drawn off liquid at the second surface of the permeable sheet at a rate which is at least about 65 percent of the rate at which the liquid is deposited on the first surface of the sheet. As a further example, liquid may be evacuated or drawn off liquid at the second surface of the permeable sheet at a rate which is at least about 75 percent of the rate at which the liquid is deposited on the first surface of the sheet. If liquid saturant is deposited on the first surface of the sheet at a rate of about 0.3 gallons per minute per inch of curtain width for a 100 inch curtain (i.e., about 30 gallons per minute), liquid may be evacuated from the second surface at a rate at least about 15 gallons per minute. Liquid already present in the permeable sheet (e.g., liquid in a partially hydrated sheet) may constitute some of the volume of the liquid evacuated or drawn off at the second surface of the permeable sheet.

Generally speaking, suitable liquid saturants should be free flowing and compatible with the specific permeable sheet used. Liquid saturants may be water-based or other solvents may be used. Liquid saturants may be solutions containing colorants, surfactants, binders, latexes, adhesives, sealers, sizings, fire retardants, disinfectants, conditioners, medicants, cleaning agents, wet-strength resins, de-bonding agents, anti-microbial agents or the like. Depositing a relatively large volume of a liquid saturant on a first surface of a permeable sheet and drawing a substantial portion of the saturant through the sheet utilizing a vacuum may provide advantages for saturant materials that can be applied at relatively low concentrations. For example, certain dyes or colorants may be present in the liquid saturant at concentrations of less than about 10 percent, by weight. Dyes or colorants may be present in the liquid saturant at concentrations of less than about 5 percent, by weight. Dyes or colorants may be present in the liquid saturant at concentrations of less than about 2 percent, by weight. Dyes or colorants may be present in the liquid saturant at concentrations of about 0.5 percent, by weight. Generally speaking, cationic direct dyes are believed to be useful in the present invention. Such dyes can be useful in adding color to a permeable sheet of fibrous cellulosic material. One particularly useful dye is a cuprous modified monoazo compound available from BASF under the trade designation Fastusol C Blue PR 949L.

Deposition of a liquid saturant in combination with a short dwell time or residence time (e.g., less than 1 second) of a substantial portion of the liquid saturant on the permeable sheet may provide advantages over conventional saturation processes having relatively long dwell times. The present invention may enable use of saturants that could otherwise harm or degrade the permeable sheet when in contact for relatively long periods of time and/or in large volumes.

Although the inventors should not be held to a particular theory of operation, several factors are believed to contribute to the uniform distribution of liquid throughout the permeable sheet. Among these are: uniform deposition of liquid saturant onto the permeable sheet, permeability of the permeable sheet, uniformity of the permeable sheet, viscosity of the liquid saturant, application of vacuum to draw a portion of the liquid saturant through the sheet, and volume of liquid saturant drawn through the permeable sheet.

Substantially uniform application of liquid saturant throughout a permeable sheet can be measured in several ways. One convenient measurement relates to the application of a colorant such as, for example, a dye solution. Substantially uniform application of a dye solution throughout a permeable sheet that is receptive to the dye generally achieves a relatively similar color intensity throughout the sheet and avoids streaks, bands, lines or other defects. Color intensity at specific locations throughout the sheet may be determined by conventional color intensity measurement techniques. Exemplary color intensity measurement equipment include Hunter Colormeter and Bausch & Lomb Spectronic 20 Colorimeter.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A continuous, short dwell time process of non-compressively and uniformly applying a liquid saturant throughout a permeable sheet, the process comprising:

providing a continuously advancing permeable sheet having a first surface and a second surface;

depositing a substantially laminar flowing curtain of liquid saturant generally across and onto the first surface of the continuously advancing permeable sheet; and applying a vacuum to the second surface of the continuously advancing permeable sheet substantially simultaneous with the deposition of the liquid saturant; and drawing a substantial portion of the liquid saturant through the permeable sheet in less than about 1 second to generate a substantially uniform distribution of liquid saturant throughout the permeable sheet.

2. The process of claim 1, wherein a substantial portion of the liquid saturant is drawn through the permeable sheet in less than about 0.1 second.

3. The process of claim 1, wherein a substantial portion of the liquid saturant is drawn through the permeable sheet in less than about 0.01 second.

4. The process of claim 1, wherein a substantial portion of the liquid saturant is drawn through the permeable sheet in less than about 0.001 second.

* * * * *